US005318753A

United States Patent [19]

Honda

[11] Patent Number: 5,318,753

[45] Date of Patent: Jun. 7, 1994

[54] CONTAINER FOR HOLDING DISPOSABLE TIPS AND PACKAGE ACCOMMODATING THE CONTAINER

[75] Inventor: Hisashi Honda, Mitaka, Japan

[73] Assignee: Aloka Co., Ltd., Japan

[21] Appl. No.: 5,369

[22] Filed: Jan. 19, 1993

[30] Foreign Application Priority Data

Jan. 17, 1992 [JP] Japan ..... 4-001277[U]
Jan. 17, 1992 [JP] Japan ..... 4-001278[U]

[51] Int. Cl.[5] ..... B01L 9/00

[52] U.S. Cl. ..... 422/104; 422/99; 206/562; 206/563; 229/915; 220/510

[58] Field of Search ..... 422/104, 99; 206/443, 206/562, 563; 229/D9, 23 R, 915; 220/510

[56] References Cited

U.S. PATENT DOCUMENTS 3,853,217 12/1974 Scordato et al. ..... 206/562
5,143,278 9/1992 Petriekis et al. ..... 229/23 R

*Primary Examiner*—Jill A. Johnston
*Assistant Examiner*—Lien Tran
*Attorney, Agent, or Firm*—Marger, Johnson, McCollom & Stolowitz

[57] ABSTRACT

A container for holding a plurality of disposable pipette tips which are to be installed to a pipette rack for a pipetting apparatus is disclosed. The container includes an upper panel having a plurality of aligned openings into which the disposable tips are to be inserted, respectively, and a lower panel for regulating swing movement of the respective disposable tips held by the upper panel. The lower panel is separated from the upper panel so as to be freely movable between a first position at which the lower panel is spaced from the upper panel and a second position at which the lower panel is close to the upper panel. The container further includes four tabs which support the lower panel thereon at the first position. The tabs are formed on side panels which are connected to the upper panel. According to the container, it is possible to install the container which holes the pipette tips to the pipette rack without applying any specific force. Further, a package which accommodates two containers as described is also disclosed. The package includes a packaging box in which the two containers are to be removably accommodated. According to the package, it is possible to ship or transport many pipette tips by one package.

10 Claims, 6 Drawing Sheets

CONTAINER FOR HOLDING DISPOSABLE TIPS AND PACKAGE ACCOMMODATING THE CONTAINER

BACKGROUND OF THE INVENTION

1. Field of the Invention

This invention relates to a container for holding disposable pipette tips, and relates more particularly to a container for holding a plurality of disposable pipette tips for use in a pipetting apparatus, which can hold a plurality of pipette tips upright in a predetermined aligned pattern and therefore install the aligned pipette tips to a pipette rack for the pipetting apparatus with the tips being held on the container. This invention further relates to a package accommodating the container, and relates more particularly to a package which accommodates two containers each holding the pipette tips so as to be able to ship or transport many disposable pipette tips with one package without being received any damage during the shipment.

2. Description of the Prior Art

In a pipetting apparatus which is used in chemical analysis and laboratory testing, many disposable pipette tips are used for supplying an object to be analyzed or a reagent to aligned many test tubes. In such a pipetting apparatus, a pipette rack having many aligned apertures to which the disposable pipette tips are to be installed is used. In use of the pipetting apparatus, the disposable tips which have been installed in the pipette rack are attached to sampling nozzles of the apparatus and then sample the object to be analyzed or reagent through the disposable tips and pipette it to the test tubs automatically.

In the meantime, conventionally, disposable pipette tips are taken out from a vinyl bag or carton in which many tips are contained at random and then they are installed in the apertures of the pipette rack one by one manually. For example, if the number of the apertures of the pipette rack is ninety, ninety tips are taken out from the bag and then they are inserted into the apertures of the pipette rack one by one manually. However, this operation is very troublesome, and further if the number of tips to be installed is too large, it takes so long time to complete the operation.

Further, conventionally, when pipette tips are forwarded or shipped to users such as laboratories or hospitals from a manufacturer, a large number of disposable pipette tips are shipped under the condition that they are contained in a vinyl bag or a carton at random as described above. However, since the disposable tip is formed of a plastic material which is easily deformed, there is a case that some of the disposable tips are deformed when the bag or carton is pressed during the shipment.

In view of these problems, a package for unitizing and shipping pipette tips has been proposed, which is disclosed in the U.S. Pat. No. 5,057,282.

The proposed package includes a container for holding a plurality of pipette tips upright in a predetermined array pattern, and an open-topped box which can accommodate the container.

The container includes an upper array holding panel having a plurality of openings therethrough in a predetermined array pattern, and a lower array holding panel lying beneath and spaced from the upper array holding panel. The lower array holding panel also has a plurality of openings therethrough that substantially match in vertical alignment and in array pattern the plurality of openings in the upper array holding panel. Between the upper and lower array holding panels, there is formed side panels which connect the lower array holding panel to the upper array holding panel. At the fold lines between the lower array holding panel and the side panels, there are formed frangible connections which are fractured by a compressive force exerted on the upper and lower array holding panels causing them to move toward each other. The frangible connections are formed from perforated fold lines which can be relatively easily to separate the lower panel from the side panels when the compressive force is exerted on the upper and lower array holding panels.

Further, the open-topped box is constituted so as to be able to accommodate the container which holds the tips. The container is removably accommodated in the open-topped box. The open-topped box further includes an integrally formed cover which covers the accommodated container. In the accommodated condition, tip portions of the tips are protruded into a hollow space defined in the box and movements of the tips are regulated by the array holding panels. Therefore, there is less possibility that the tips are damaged during the shipment thereof.

In use of the package at the point of use, first the container with many tips is removed from the box. Next, the container is placed onto a pipette support having many aligned apertures which are positionally corresponding to the openings of the array holding panels in such a manner that each of the tips is inserted into the corresponding aperture in the pipette support. Thereafter, the operator press the container against the pipette support until the perforated fold lines are torn. When the perforated fold line are torn, the lower array holding panel is brought into contact with the upper panel and then the pipette tips are installed onto the pipette support through the overlapped panels.

The proposed package for unitizing and shipping pipette tips are convenient since it is not necessary to perform such operation that installs the pipette tips into the apertures of the pipette support one by one manually. Further, there is less possibility that any damage is suffered during the shipment.

However, the conventional proposed package requires in use to press the container against the pipette support until the perforated fold lines are torn, which requires a certain force which is suitable to tear the perforated fold lines. If given force is too large, there is a possibility that some of the tips which are held in the container fall out from the container due to the reaction which would be caused when the upper array holding panel abut with the pipette support after the perforated fold lines are torn. Therefore, it is required to determine a suitable force for tearing the perforated fold lines when used. Furthermore, in the conventional proposed package, it is necessary to form the perforated lines to a blank of the container in the manufacturing process thereof. However, the process which forms the perforated lines is relatively troublesome. Moreover, in the conventional proposed package, the number of pipette tips which can ship with one package is limited because only one container is accommodated in the package.

SUMMARY OF THE INVENTION

In view of the above mentioned problems in the conventionally proposed package for unitizing and shipping pipette tips, it is a primary object of the present invention to provide a container for holding a plurality of disposable pipette tips which are to be installed to a pipette rack for a pipetting apparatus, which can easily install the tips to the pipette rack for the apparatus without applying any specific force to the container when installed.

Another object of the present invention is to provide a package which can ship or transport many disposable pipette tips in aligned condition without being received any damage during the shipment.

In order to achieve the primary object, a container for holding a plurality of disposable pipette tips which are to be installed to a pipette rack for a pipetting apparatus according to the present invention comprises an upper panel having a plurality of aligned openings into which the disposable tips are to be inserted, respectively, and a lower panel for regulating swing movement of the respective disposable tips held by the upper panel. The lower panel is separated from the upper panel so as to be freely movable between a first position at which the lower panel is spaced from the upper panel and a second position at which the lower panel is close to the upper panel. The container further includes means for supporting the lower panel thereon at the first position.

According to the above described container, it is possible to install the pipette tips to the pipette rack only by placing the container with the pipette tips onto the rack such that tip portions of the respective tips are inserted into the apertures of the rack. In this case, since the lower panel is separated from the upper panel and freely movable between the first and second positions, the lower panel is automatically moved toward the upper panel due to the weight of the container and the tips without applying any specific force to the container. Therefore, it is possible to easily install the pipette tips to the pipette rack. Further, according to the present invention, since it is not necessary to form such perforated lines to a blank of the container, manufacturing process of the container becomes easy in comparison with the container of the conventional proposed package.

In the present invention, the lower panel may also include a plurality of aligned openings which positionally correspond to the aligned openings in the upper panel in such a manner that the disposable tips to be inserted into the openings of the upper panel are also inserted into the positionally corresponding openings in the lower panel.

Further, it is preferable that the upper panel is formed into a substantially rectangular shape having four edges and side panels are connected to each of the edges of the upper panel so as to define an under-opened space therein in cooperation with the upper panel. In this case, it is also preferable that the lower panel is formed into such configuration and size that can be accommodated in the space in a freely movable manner between the first and second positions.

Furthermore, it is preferable that the supporting means is formed from four tabs extended into the space in such a manner that the upper panel is supported thereon at the first position. The tabs are preferably formed by notching two parts of each of the elongated confronting side panels and folding the notched parts inwardly.

In order to achieve another object, a package for carrying a plurality of disposable tips for use in a pipetting apparatus comprises a first container for holding a plurality of disposable tips and a second container for holding a plurality of disposable tips. Each of the first and second containers has a plurality of openings in which the plural disposable tips are to be inserted, respectively. The package further comprises a foldable packaging box including two confronting front and rear walls and two side walls which are connected so as to define a substantially rectangular hollow space therein. In the hollow space, there are defined at one side thereof a first accommodating section to which said first container is removably accommodated and at the other side thereof a second accommodating section to which said second container is removably accommodated are provided. The packaging box further includes two covers for covering said first and second containers accommodated in the first and second accommodating sections, respectively. Each of the covers is connected to each of the front and rear walls, respectively. In this package, the first and second containers are accommodated in the first and second accommodating section, respectively, in such a manner that tip portions of the disposable tips which would be held by the respective containers are extended into the hollow space.

According to the package as described above, it is possible to ship or transport two containers which are holding a plurality of disposable tips, respectively. Therefore, it becomes possible to increase the number of disposable pipette tips which can be sipped by one package in comparison with the conventional proposed package.

Other objects, structures and advantages of the present invention will be apparent from the following description of the preferred embodiments and the accompanying drawings.

DETAILED DESCRIPTION OF THE PREFERRED EMBODIMENTS

With reference to the attached drawings, the preferred embodiment of the present invention will be described.

Figure 1:
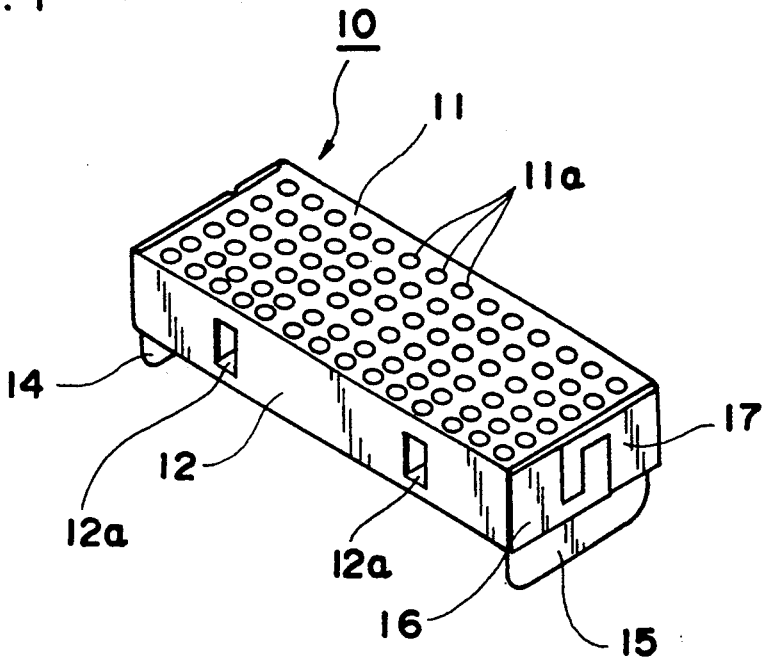
FIG. 1 is a perspective view of a container of the present invention which is shown from the upper side thereof.
Figure 2:
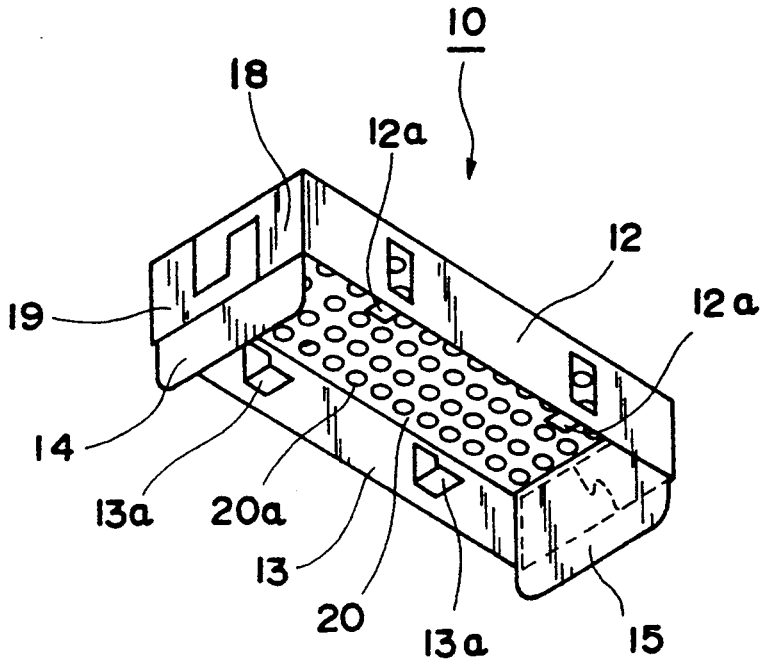
FIG. 2 is a perspective view of a container of the present invention which is shown from the lower side thereof.
Figure 7:
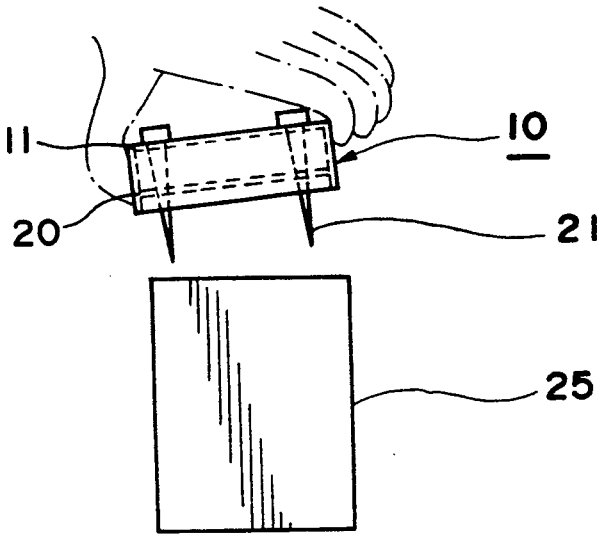
FIG. 7 is an explanatory view showing the condition when the container is installed to a pipette rack for a pipetting apparatus.
Figure 8:
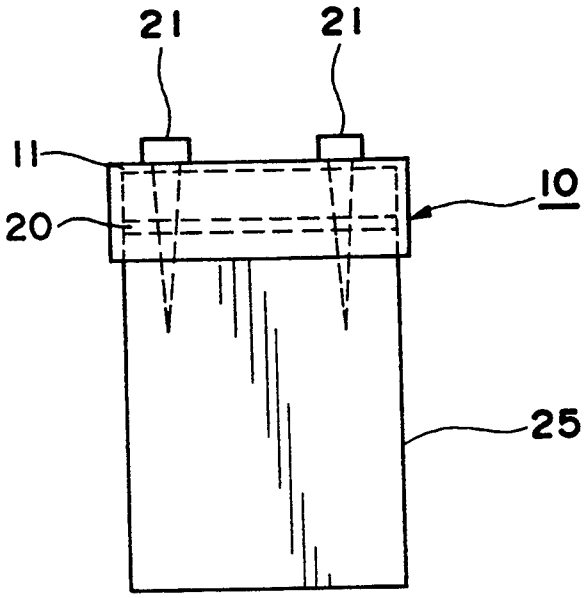
FIG. 8 is an explanatory view showing the condition that the container is placed onto the pipette rack.
Figure 9:
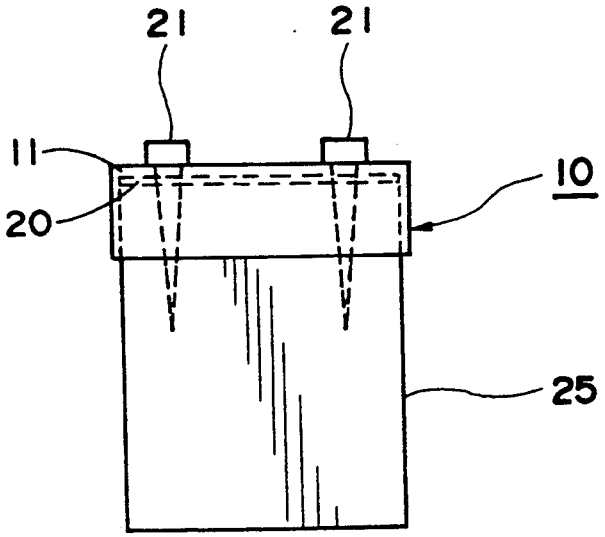
FIG. 9 is an explanatory view showing the condition that the container has been installed to the pipette rack.

FIGS. 1 and 2 show a container 10 for holding a plurality of disposable pipette tips 21 according to the embodiment of the present invention. As illustrated in FIGS. 7 to 9, these disposable pipette tips 21 are to be installed to a pipette rack 25 of a pipetting apparatus in a laboratory or hospital as being held by the container, when used.

As shown in the drawings, the container 10 has a rectangular upper panel 11, side panels 12 and 13, side flaps 14 and 15, and locking tabs 16–19. In the upper panel 11, there are formed a plurality of aligned openings 11*a* (e.g. eighty-four openings in this embodiment) to which disposable pipette tips are to be inserted, respectively. The positions and alignment of these openings correspond to the apertures formed in the pipette rack 25. The size of each opening 11*a* is determined so as to be able to hold or support the inserted disposable tip. To the four edges of the upper panel 11, elongated rectangular side panels 12 and 13 and side flaps 14 and 15 are integrally connected through fold lines, respectively. Further, at the opposite edges of each of the side panels 12 and 13 which are not connected to the upper panel 11, locking tabs 16, 18 and 17, 19 are integrally connected through fold lines, respectively. The locking tabs 16 and 18 connected to the side panel 12 are constituted so as to be engaged with the locking tabs 17 and 19 connected to the other side panel 13, respectively, over each of the side flaps 14 and 15 which have been folded at right angle with respect to the upper panel 11. Each of the side flaps 14 and 15 is configurated such that an end part thereof is protruded below over the engaged locking tabs.

The upper panel 11, the side panels 12 and 13, and the side flaps 14 and 15 are formed from a blank which is cut from card board or paper board or any other suitable materials. Further, when the upper panel 11, the side panels 12 and 13, and the side flaps 14 and 15 are assembled by folding the respective portions, they form an under-opened rectangular box configuration which defines a hollow space therein.

Further, in each of the side panels 12 and 13, there are formed two lower panel supporting tabs 12*a*, 12*a* and 13*a*, 13*a*, respectively. These tabs 12*a*, 12*a* and 13*a*, 13*a* are formed by notching predetermined two portions of the respective side panel into U-shape so as to have a lower part which is connected to the side panel, and then by folding thus formed notched portions inwardly, respectively, that is toward the hollow space by utilizing the lower parts as fold lines. In this case, it is preferable that the four tabs 12*a*, 12*a* and 13*a*, 13*a* are formed in such a manner that they are located on the same plane spaced from the upper panel 11 inside the rectangular hollow space. Further, it is also preferable that a pair of two opposed tabs in the opposite side panels positionally correspond to each other.

Figure 3:
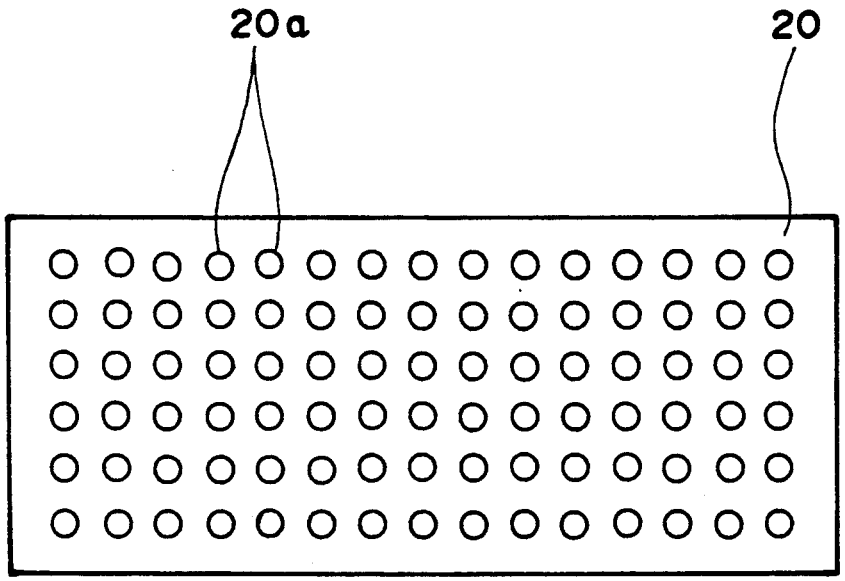
FIG. 3 is a plan view of the lower panel of the container of the present invention.

As shown in FIG. 2, in the hollow space, that is in the under-opened rectangular box configuration, there is provided a lower panel 20 which is also formed from card board or paper board. As clearly shown in FIG. 3, the lower panel 20 also has a rectangular configuration having the size and shape substantially the same as those of the upper panel 11 or slightly smaller than those of the upper panel 11 so as to be freely movable between a first position at which the lower panel 20 is supported on the four supporting tabs 12*a*, 12*a* and 13*a*, 13*a* and spaced from the upper panel 11 and a second position at which the lower panel 20 contacts with the upper panel 11.

In the lower panel 20, there are also formed a plurality of aligned openings 20*a*, of which number is the same as that of the upper panel 11 (e.g. eighty-four in this embodiment). Further, the positions of these openings 20*a* substantially correspond to those of the upper panel 11 in vertical alignment. The size of each opening 20*a* of the lower panel 20 is substantially the same as that of the opening 11*a* of the upper panel 11 so as to allow the lower panel 20 to smoothly move from the first position to the second position.

Figure 4:
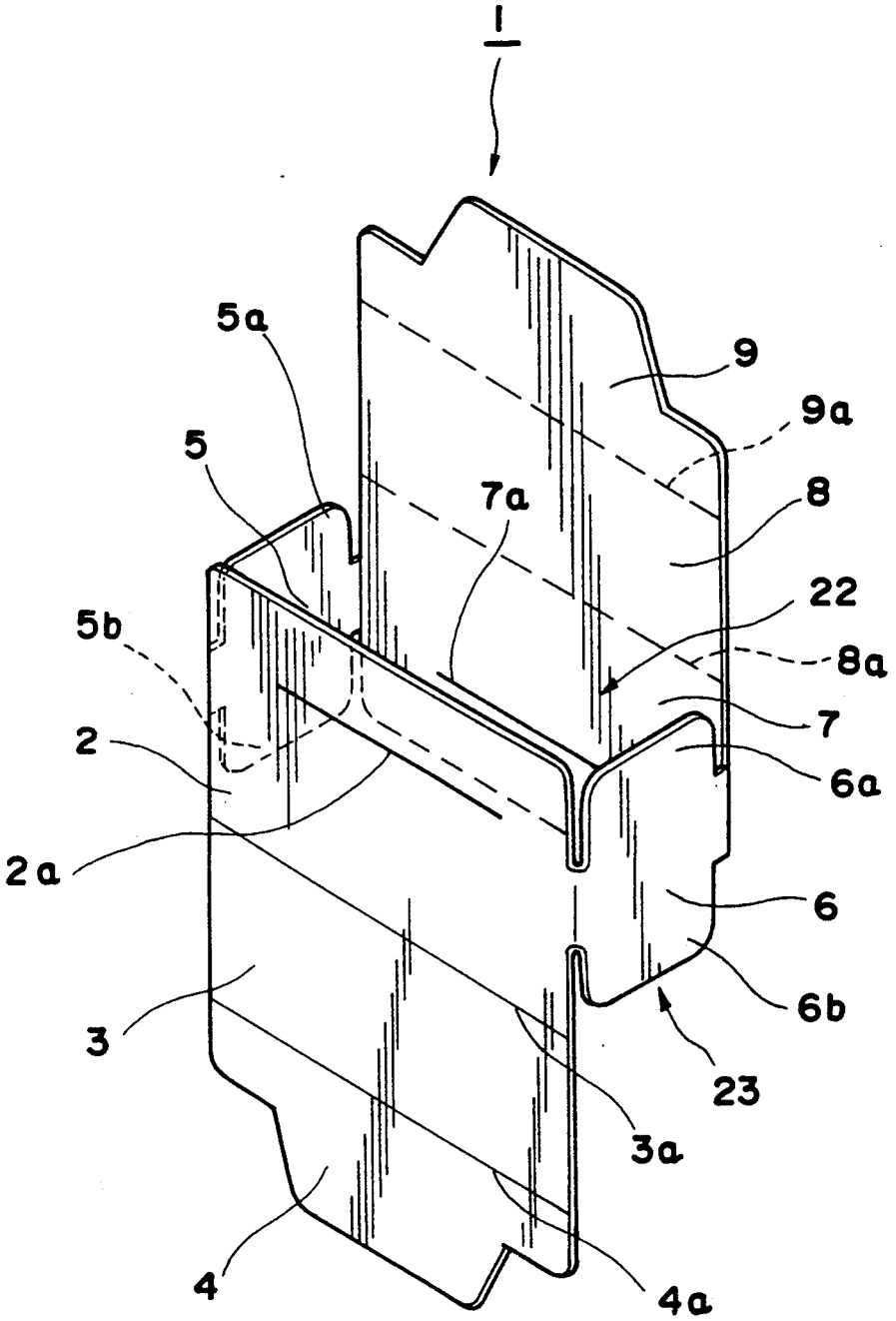
FIG. 4 is a perspective view of a packaging box of the present invention.
Figure 5:
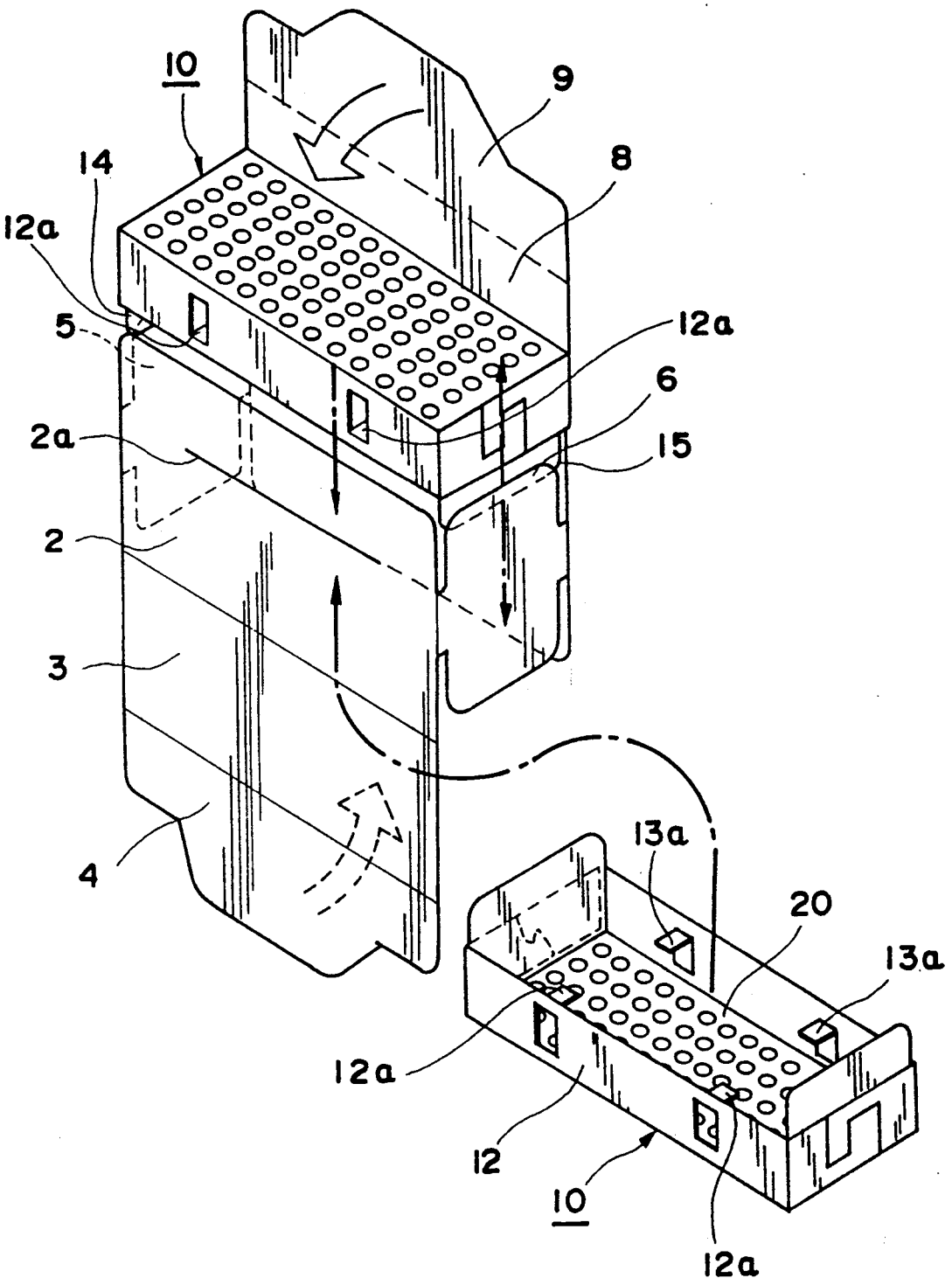
FIG. 5 is an exploded perspective view showing the package of the present invention.

FIG. 4 is a perspective view of a packaging box 1 in which two containers 10 are to be accommodated. A package according to the present invention is constituted from the packaging box 1 and the two containers 10 accommodated in the packaging box 1.

The packaging box 1 is also formed from a blank which is cut from card board or paper board. The packaging box 1 which has been assembled includes a front wall 2, a rear wall 7 which is opposite to the front wall 2 and a pair of side walls 5 and 6 which are opposite to each other. The length of the transverse direction of the respective front and rear walls thereof is substantially the same as the length of the longitudinal direction of the upper panel 11 and the length of the transverse direction of the respective side walls is substantially the same as that of the transverse direction of the respective side flaps 14 and 15. Further, these front wall 2, rear wall 7 and side walls 5 and 6 are connected to each other at the respective vertical edges so as to define a substantially rectangular hollow space having four corners. Therefore, the rectangular hollow space provides upper and lower container accommodating sections each having size and shape in which the container 10 can be tightly fitted.

At each of the four corners of the rectangular hollow space, there are formed two notches at both the upper and lower portion thereof. The length of each notch is substantially the same as the vertical length of the locking tab of the container 10. As a result of this, there are formed container support portions 5*a*, 5*b* and 6*a* and 6*b* at the upper and lower sides of each of the side walls 5 and 6. These container support portions 5*a*, 5*b* and 6*a* and 6*b* will be inserted into the respective spaces formed between the engaged locking tabs 16, 17 and the side flap 15 and between the engaged locking tabs 18 and 19 and the side flap 14 of each container 10, respectively, when the containers 10 are fitted to the packaging box 1.

Further, a lower cover portion 3 having substantially the same size and shape as those of the upper panel 11 of the container 10 is integrally connected at one longitudinal edge thereof to the lower edge of the front wall 2 through a fold line 3*a*. Further, an inserted end portion 4 is integrally connected at a longitudinal edge thereof to the opposite longitudinal edge of the lower cover portion 3 through a fold line 4*a*. The inserted end portion 4 has a protruding portion at the opposite side of the longitudinal edge thereof which will be inserted into a transverse slit 7*a* formed in the rear wall 7. Therefore, the lower cover portion 3 serves as a cover of the lower opening of the packaging box 1 when the protruding portion of the inserted end portion 4 is inserted into the slit 7*a*.

On the other hand, an upper cover portion 8 also having substantially the same size and shape as those of the upper panel 11 of the container 10 is integrally connected at one longitudinal edge thereof to the upper edge of the rear wall 7 through a fold line 8*a*. Further, an inserted end portion 9 is integrally connected at a longitudinal edge thereof to the opposite longitudinal edge of the upper cover portion 8 through a fold line 9*a*.

The inserted end portion 9 has a protruding portion at the opposite side of the longitudinal edge thereof, which will be inserted into a transverse slit 2a formed in the front wall 2. Therefore, the upper cover portion 8 serves as a cover of the upper opening of the packaging box 1 when the protruding portion of the inserted end portion 9 is inserted into the slit 2a in the same way as the lower cover portion 4.

When the upper and lower cover portions 3 and 8 and the respective inserted portions 4 and 9 are folded as described above, the packaging box 1 provides a closed shipping package.

Hereinafter, it will be described how to use the containers 10 and the packaging box 1 described above. First, in preparation of the shipment of the disposable tips, disposable pipette tips 21 are inserted into the openings 11a of the upper panel 11 of the respective containers 10. In this case, the lower panel 20 of the respective containers 10 is in the first position at which the lower panel 20 is supported on the support tabs 12a and spaced from the upper panel 11. Therefore, the respective pipette tips 21 which have been inserted into the openings 11a of the upper panel 11 are also inserted into the corresponding openings 20a of the lower panel 20, so that the respective tips 21 are held or supported by the two spaced panels 11 and 20. As a result, swing movement of the respective tips 21 is regulated by the lower panel 20.

After the operation that inserts the pipette tips 21 to the openings 11a and 20a of two containers 10 is complete, one container which holds the pipette tips 21 is accommodated into the upper open space (upper container accommodating section) of the packaging box 1 which is defined by the upper portions of the front and rear walls 2 and 7 and side walls 5 and 6. In this case, as described above, the container 10 is fitted to the packaging box 1 such that the container support portions 5a and 6a of the side walls 5 and 6 are inserted into the respective spaces formed between the engaged locking tabs 16, 17 and the side flap 15 and between the engaged locking tabs 18 and 19 and the side flap 14 of the container 10, respectively. Further, since the swing movements of the respective tips which are held by the container 10 are regulated by the lower panel 20, the fitting operation can be carried out with ease. In other words, there is less possibility that any of the tip portions of the pipette tips 21 are caught by the walls of the packaging box 1 when the container 10 is accommodated.

After the container 10 is accommodated in the upper open space of the packaging box 1, the upper cover portion 8 is folded onto the container 10 along the fold line 8a to press the container 10 from the upper side thereof. Thereafter, the inserted portion 9 is also folded along the fold line 9a and then the protruded portion thereof is inserted into the slit 2a of the front wall 2. By these operations, the container 10 is packaged in the packaging box 1.

After this, the packaging box 1 which accommodates the container 10 is reversed in such a manner that the lower open space (lower container accommodating section) of the packaging box 1 which is defined by the lower portions of the front and rear walls 2 and 7 and side walls 5 and 6 is directed upwardly. In this state, another container 10 which holds the pipette tips 21 is accommodated into the space. The operation for accommodating the container 10 into the space is the same as that described with reference to the container 10 which has been accommodated in the upper open space of the packaging box 1. Therefore, detailed description of the accommodating operation for the other container 10 has been omitted.

Figure 6:
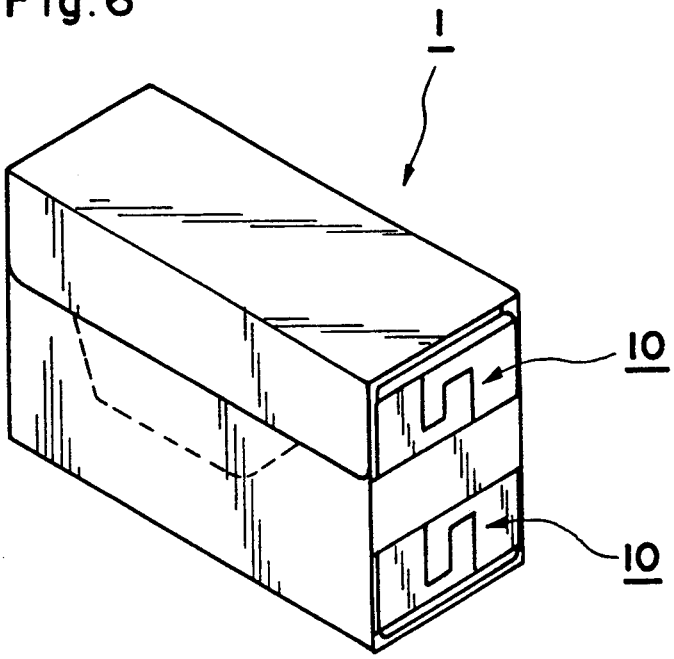
FIG. 6 is a perspective view showing the package of the present invention under the condition that the package is shipped.

According to these operations, the two containers 10 which hold many pipette tips are accommodated in the packaging box 1 as shown in FIG. 6. The package constituted from the packaging box 1 and the containers 10 is then shipped or transported to the point of use such as a laboratory under this condition. As a result, there is less possibility that the pipette tips contained therein would be received any damage during the shipment. Further, it becomes possible to ship about twice as many tips as those that could be shipped by the conventional proposed package.

After the package which accommodates the two containers 10 arrives at the laboratory, the containers 10 are taken out from the packaging box 1 by pulling out the inserted portions 4 and 9 from the slits 7a and 2a, respectively. The container 10 which has been taken out is then installed onto the pipette rack 25 which has an upper surface slightly smaller than the lower panel 20, as shown in FIG. 7. In this case, since the lower panel 20 is in the first position which regulates the swing movement of the respective pipette tips 21, it is easy to insert the respective pipette tips 21 to the corresponding apertures in the pipette rack 25. When the container 10 is placed onto the pipette rack 25 with the condition that the respective pipette tips 21 are properly inserted into the corresponding apertures, as shown in FIG. 8, the lower panel 20 is automatically moved toward the second position at which the lower panel 20 is brought into contact with the upper panel 11 by the weight of the container 10 and the pipette tips 21. Therefore, it is possible to install the container 10 holding the pipette tips 21 to the pipette rack 25 without applying any specific force, thus resulting in easy installing operation of the pipette tips 21 to the pipette rack 25. In a case where there is a little difficulty in the movement of the lower panel 11 due to frictional force between the pipette tips 21 and the lower panel 20, it is preferable to shake the container 10 with a hand.

By these operations, the installation of the container 10 to the pipette rack 25 is complete. In this condition, pipetting operation is performed by the pipetting apparatus (not shown). When the pipetting operation is complete, the pipette tips 21 are removed from the pipette rack 25 as being held by the container 10, and then it possible to dispose of the pipette tips 21 together with the container 10.

As described above with reference to the preferred embodiment, according to the present invention, it is possible to install the container holding the pipette tips to the pipette rack without applying any specific force thereto, thus leading to easy installing operation of the container to the pipette rack. Further, since it is not necessary to form perforated lines like the prior art, the manufacturing process of the container becomes easy. Furthermore, since the packaging box according to the present invention can accommodate two containers therein as described above, it is possible to ship or transport so many pipette tips by one package without receiving any damage during shipment.

Finally, it should be noted that the present invention is not limited to the embodiment described above. The scope of the present invention is determined by the following claims.

What is claimed is:

1. A container for holding a plurality of disposable tips for use in a pipetting apparatus, which comprises:

an upper panel having a plurality of openings into which the disposable tips are to be inserted, respectively, said upper panel having a substantially rectangular shape having four edges;

elongated side panels connected to each of said edges of said upper panel defining an under-opened space in association with said upper panel;

a lower panel having a plurality of openings aligned with the openings of said upper panel when engaged together for regulating swing movements of the respective disposable tips held by said upper panel, said lower panel being separated from the upper panel so as to be freely movable within said space between a first position at which said lower panel is spaced from the upper panel and a second position at which said lower panel is adjacent to the upper panel, said lower panel having such a configuration that can be accommodated in the underopened space in a freely movable manner between the first and second position; and means for supporting said lower panel at the first position, said supporting means comprising at least two foldable tabs provided on confronting side panels at a position spaced from the upper panel and extending into the space in such a manner that the lower panel is supported thereon at the first position.

2. The container for holding a plurality of disposable tips as claimed in claim 1, wherein the disposable tips which would be inserted into the openings of said upper panel are also inserted into said aligned corresponding openings in said lower panel.

3. The container for holding a plurality of disposable tips as claimed in claim 2, wherein each tab is formed by notching a part of the side panel and then folding the notched part inwardly such that the tabs are pushed back into their original unfolded position when the lower panel is pushed into the second position by a pipette rack.

4. The container for holding a plurality of disposable tips as claimed in claim 3, wherein said tabs are located at a position on said lower panel so that said lower panel when supported at the first position supports around a middle portion of each disposable tip.

5. The container for holding a plurality of disposable tips as claimed in claim 1, wherein the lower panel is sized to be easily moved from the first position toward the second position without having to apply an additional disengagement force to disengage the lower panel from the side panels when said container is placed onto a pipette rack having a plurality of openings on its upper surface.

6. A package for carrying a plurality of disposable tips for use in a pipetting apparatus, which comprises:

first and second containers each for holding a plurality of disposable tips, each of said first and second containers having a plurality of openings in which the plural disposable tips are to be inserted, respectively, in which each of said first and second containers comprises an upper panel having a plurality of openings into which the disposable tips are to be inserted, respectively, said upper panel having a substantially rectangular shape having four edges;

elongated side panels connected to each of said edges of said upper panel defining an under-opened space in association with said upper panel;

a lower panel having a plurality of opening aligned with the opening of said upper panel when engaged together for regulating swing movements of the respective disposable tips held by said upper panel, said lower panel being separated from the upper opened so as to be freely movable within said space between a first position at which said lower panel is spaced from the upper panel and a second position at which said lower panel is adjacent to the upper panel, said lower panel having a configuration that is accommodated in the under-opened space in a freely movable manner between the first and second positions;

means for supporting said lower panel at the first position, said supporting means comprising at least two foldable tabs provided on confronting side panels at a position spaced from the upper panel and extending into the space in such a manner that the lower panel is supported thereon at the first position; and a foldable packaging box including two confronting front and rear walls and two side walls which are connected so as to define a substantially rectangular hollow package space therein in which at a first side thereof a first accommodating section to which said first container is removably accommodated and at the other side thereof a second accommodating section to which said second container is removably accommodated are provided, and two covers each connected to said front and rear walls, respectively, for covering said first and second containers accommodated in the first and second accommodating sections, respectively.

7. The package for carrying a plurality of disposable tips as claimed in claim 6, wherein said first and second containers are accommodated in the first and second accommodating sections, respectively, in such a manner that tip portions of the disposable tips held by the respective containers extend into the hollow space.

8. The package for carrying a plurality of disposable tips as claimed in claim 7, wherein each of said side walls includes means for supporting the first and second container.

9. The package for carrying a plurality of disposable tips as claimed in claim 8, wherein said supporting means of said sidewalls includes a pair of protruded portions provided in the side walls.

10. The package for holding a plurality of disposable tips as claimed in claim 6, wherein the disposable tips which would be inserted into the openings of said upper panel are also inserted into the aligned corresponding openings in said lower panel.

* * * * *